US007865976B2

(12) United States Patent
Beddoe et al.

(10) Patent No.: US 7,865,976 B2
(45) Date of Patent: Jan. 11, 2011

(54) HELMET VENT AIRFLOW REGULATOR AND SHIELD

(75) Inventors: Andrew Beddoe, Seattle, WA (US); Joe Seagraves, Seattle, WA (US); Aaron Ambuske, Seattle, WA (US)

(73) Assignee: K-2 Corporation, Seattle, WA (US)

( * ) Notice: Subject to any disclaimer, the term of this patent is extended or adjusted under 35 U.S.C. 154(b) by 831 days.

(21) Appl. No.: 11/543,757

(22) Filed: Oct. 4, 2006

(65) Prior Publication Data

US 2007/0130672 A1 Jun. 14, 2007

Related U.S. Application Data

(60) Provisional application No. 60/723,677, filed on Oct. 4, 2005.

(51) Int. Cl.
*A63B 71/10* (2006.01)
*A42B 3/00* (2006.01)
*A42C 5/04* (2006.01)

(52) U.S. Cl. ..... 2/425; 2/411; 2/171.4

(58) Field of Classification Search ..... 2/410, 2/411, 414, 425, 171.4, 171.7, 209.3
See application file for complete search history.

(56) References Cited

U.S. PATENT DOCUMENTS 1,774,074 A * 8/1930 Wittcoff ..... 2/171.7
4,995,117 A 2/1991 Mirage
5,298,208 A 3/1994 Sibley
6,247,186 B1 6/2001 Huang
6,711,751 B1 3/2004 Muskovitz
6,823,531 B1 * 11/2004 Chen ..... 2/171.3
7,137,153 B2 11/2006 Hussey
2002/0124298 A1 * 9/2002 Muskovitz ..... 2/410
2004/0064873 A1 4/2004 Muskovitz
2004/0250339 A1 12/2004 Musal
2005/0160521 A1 7/2005 Hussey
2005/0160522 A1 7/2005 Ambuske
2005/0183190 A1 8/2005 Hussey
2005/0241049 A1 11/2005 Ambuske

* cited by examiner

*Primary Examiner*—Gary L Welch
*Assistant Examiner*—Amber R Anderson
(74) *Attorney, Agent, or Firm*—Christensen O'Connor Johnson Kindness PLLC

(57) ABSTRACT

A helmet with large vent openings includes a vent shield to prevent the penetration of foreign objects and a vent airflow regulator positioned over the vent shield so as to regulate the amount of airflow allowed within the interior of the helmet. The vent shield is attached to the foam liner during the in-mold process, while the vent airflow regulator is positioned behind the vent shield after the in-mold process in a post-applied manner. A foam insert is positioned behind the vent airflow regulator and also has vent openings.

14 Claims, 8 Drawing Sheets

HELMET VENT AIRFLOW REGULATOR AND SHIELD

CROSS-REFERENCE TO RELATED APPLICATION

This application claims the benefit of U.S. Provisional Application No. 60/723,677, filed Oct. 4, 2006, the benefit of which is hereby claimed under 35 U.S.C. §119.

BACKGROUND

Helmets have typically included vents that allow the passage of air from the exterior to the interior of a helmet for the removal of heat and moisture from the head area of a user. Typically, the larger the vent holes in the helmet, the greater the quantities of heat and moisture that can be removed from the user. However, large vent holes may permit foreign objects to enter the vents, potentially causing injury to the head of the user.

Accordingly, there is a need to provide helmets having aesthetically pleasing and functional vents without exposing the user to the risks from the intrusion of foreign objects.

SUMMARY

A helmet with large vent openings includes a vent shield positioned over the vent openings, the vent shield having vent holes of a predetermined size smaller than the vent openings to prevent the intrusion of foreign objects. A vent airflow regulator is positioned behind the vent shield to regulate the amount of air passing through the vent openings and vent shield. The vent shield is attached to an inner foam liner of the helmet during the foaming process. The vent airflow regulator is not applied to the liner during the foaming process and is applied afterwards. This helps to minimize the weight of the helmet, as the vent shield/vent airflow regulator assembly need not be able to withstand the pressure and temperature of the foaming process. A foam insert is positioned behind the vent airflow regulator and also has vent openings to allow the passage of air into the interior of the helmet.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
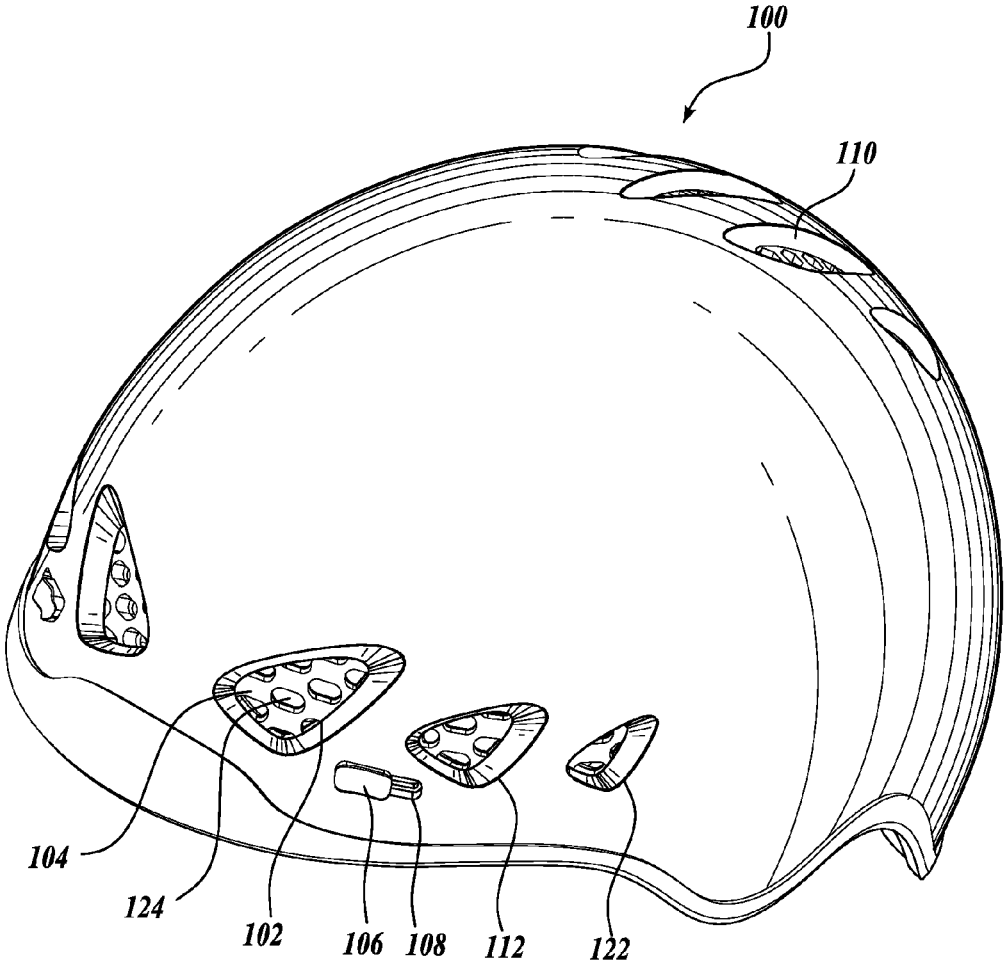
FIG. 1 is a diagrammatical illustration of a helmet in accordance with one embodiment of the present invention.

FIG. 1 is a diagrammatical illustration of a helmet 100 in accordance with one embodiment of the present invention. The helmet 100 includes a plurality of vent holes for the passage of air, such as front vent holes 102, 112, and 122. Vent holes 102, 112, and 122 may be of the same size or of different sizes. Additionally, similar vent holes may be positioned on the opposite side of the helmet so that the vent holes on the opposite side are symmetrical to vent holes 102, 112, and 122. Additionally, top or rear vent holes 110 may also be provided on the helmet for the exit of the air carrying moisture and heat away from the helmet 100. Vent holes 102, 112, and 122 extend through the exterior helmet form. The helmet form may be made of an exterior hard outer shell, such as polycarbonate. Interior to the shell, a lighter foam may be used, such as expanded polystyrene. The vent holes 102, 112, and 122 can be made in a first large size that is suitable to permit sufficient airflow into the interior of the helmet. A vent shield 164 that is visible through the opening of the vent holes 102, 112, and 122 is positioned over the vent holes 102, 112, and 122. The vent shield 104 may expand across the three vent holes 102, 112, and 122. Alternatively, an individual vent shield may be provided for each one of vent holes 102, 112, and 122. The vent shield 104 includes vent holes 124 which are of a size smaller than the vent holes 102, 112, and 122. Therefore, a plurality of vent holes 124 of the vent shield 104 is visible in each one of the vent holes 102, 112, and 122. Vent holes 124 in vent shield 104 are made of a predetermined size, the size being determined by the maximum size of foreign objects that is desired to be restricted from intruding into the helmet. Therefore, vent holes 124 made in vent shield 104 may be smaller than any one of the vent holes 102, 112, and 122 provided in the helmet form. Accordingly, a plurality of vent holes 124 may be visible within any one of the vent holes 102, 112, and 122.

As will be described below, a vent airflow regulator is provided over the vent shield 104 so as to regulate the amount of airflow into the interior of the helmet through the vent holes 102, 112, and 122 and the individual vent holes 124 of the vent shield 104. Controlling vent airflow is provided by adjusting the knob 106, which slides to the left and to the right within the slot 108 in the helmet form. The knob 106 is attached to an arm of the vent airflow regulator that extends out from the slot 108.

Figure 2:
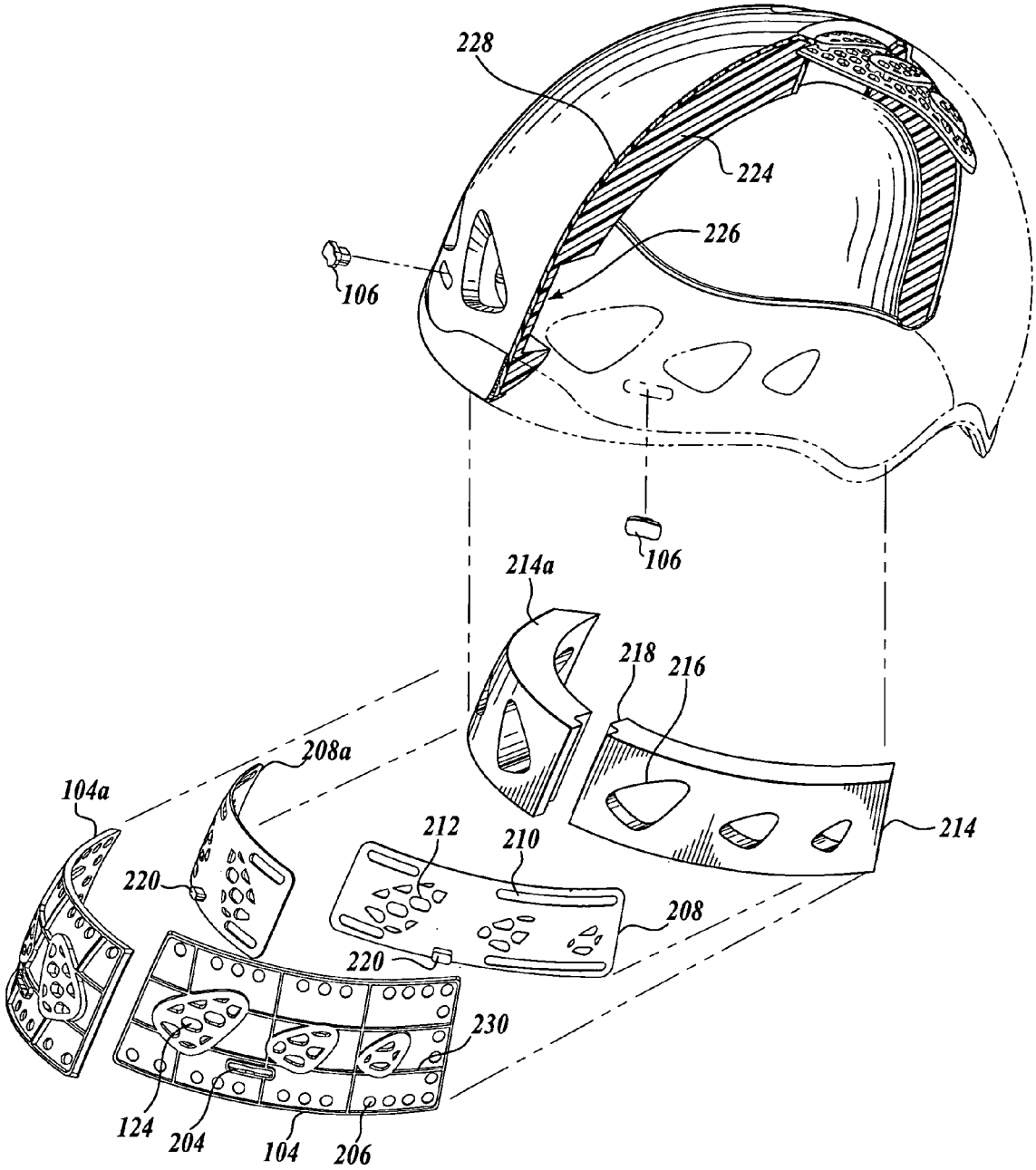
FIG. 2 is a diagrammatical illustration of an exploded view of the helmet of FIG. 1.

Referring to the exploded illustration of FIG. 2, the components of the helmet 100 are more clearly visible. The helmet 100, in one embodiment, includes an exterior shell 228 and a foam liner 224 that is interior to the shell 228. The vent shield 104 can be made from a durable material, such as a hard plastic or metal in the shape matching the curvature of the helmet form. The vent shield 104 includes the vent holes 124 arranged in three distinct patterns so as to coincide with the three vent holes 102, 112, and 122 of the helmet form. However, the vent holes 124 made in the vent shield 104 are individually smaller than any of the vents 102, 112, and 122 made in the helmet form. Anchor holes 206, the function of which will be explained below, are provided around the perimeter of the vent shield 10. Anchor holes 206 anchor the vent shield 104 to the interior foam liner 224. The vent shield includes ribs 230 that criss cross the front side of the vent shield 104 and help to add rigidity to the vent shield 104. Positioned over and behind the vent shield 104 is the vent airflow regulator 208.

The vent airflow regulator 208 includes vent holes 212 that are provided in patterns that coincide with the patterns of the vent holes 124 of the vent shield 104 and are at least about as large as the vent holes 124 of the vent shield 104. The vent airflow regulator 208 includes guides 210 (or slots) that fit within matching linear rails on the back of the vent shield 104. The guides 210 are at least longer than the rails by one length of a vent hole 124 or 212, so that guides 210 can slide back and forth over the rails by at least one vent hole length. Alternatively, other means for providing a sliding engagement between the vent shield 104 and the vent airflow regulator 208 may be provided. The amount of sliding that occurs between the vent shield 104 and the vent airflow regulator 208 should be at least able to cover the distance of one vent hole 124 or 212. In this manner, the vent airflow regulator 208 can be positioned so that the vent holes 212 are exactly aligned with the vent holes 124 of the vent shield 104 and provide the maximum of vent airflow. Thereafter, being able to also position the vent airflow regulator 208 an amount that is equal to the length of a vent hole will result in solid portions of the vent airflow regulator 208 to be aligned with vent holes 124 in the vent shield 104 so that vent holes 124 are blocked by the solid portions of the vent airflow regulator 208. Therefore, the vent airflow regulator 208 can be positioned to completely block airflow through the vent holes 122 in vent shield 104 and may also be positioned so that the vent holes 124 in the vent shield 104 are completely in alignment with the vent holes 212 of the vent airflow regulator 208 to allow the maximum amount of airflow. Additionally, the vent airflow regulator 208 may be positioned any amount between fully opened and fully closed. The vent airflow regulator 208 includes an arm 220 that is disposed perpendicular on the front surface of the vent airflow regulator 208. The arm 220 fits within an aperture 204 in the vent shield 104. The arm 220 is slidable to the left and to the right within the slot 204 in the vent shield 104. The arm's 220 length is sufficient to protrude from the helmet form so that the knob 106 is then placed over the arm 220 and the sliding of the vent airflow regulator 208 can be controlled from the outside of the helmet by a user.

A foam insert 214, which fits within a notch provided in the foam liner 224 and at the back of the vent airflow regulator 208, prevents the vent airflow regulator 208 from falling out of the foam liner 224. The foam insert 214 includes vent holes 216 corresponding in size to the vent holes 102, 112, and 122 in the helmet form. In the embodiment illustrated, a second set of vent holes provide symmetry to the helmet 100. Thus, there is a corresponding vent shield 104*a*, vent airflow regulator 208*a*, and foam insert 214*a* on the opposite side of the helmet 100 for each one of the vent shield 104, vent airflow regulator 208, and foam insert 214. However, the foam insert 214*a* may have the opposite step 218 to its counterpart foam insert 214 so as to be able to interlock with each other.

The shell 228 may be made from impact resistant materials, such as polycarbonate. In any event, the shell 228 should be able to withstand the temperature at which polystyrene granules are caused to expand. The shell 228 and the foam liner 224 can be joined to each other via an "in-mold" process. In this process, the vent shield 104, but not the vent airflow regulator 208, is joined to the foam liner 224. The vent airflow regulator 208 is thereafter positioned behind the vent shield 104 in a post-applied process. In the in-mold process, the shell 228 is placed within the mold and polystyrene granules or beads are then added to the mold. Heat, in the form of steam, is applied to the granules, which causes them to expand forming the foam liner 224 and fill the voids between the shell 228, which makes for a very sturdy connection between the shell 228 and foam liner 224. The vent shield 104, but not the vent airflow regulator 208 is also positioned at the appropriate location to coincide with the vent holes 102, 112, and 122. In this case, the vent shield 104 will be attached to the foam liner 224 during the foaming process. When the polystyrene expands, it will not only expand to conform to the shape of the shell 228, but the polystyrene will also expand over and around the edges of the vent shield 104 and pass into and through the anchor holes 106 positioned around the perimeter of the vent shield 104 to anchor the vent shield 104 to the liner 224. Additionally, a mandrel can be provided behind the vent shield 104 to cover areas where it is desirable not to have the foam expand. For example, a mandrel can be provided that is smaller than the perimeter of the vent shield 104. In this manner, when the mandrel is removed, it will leave behind a notch 226 in the foam liner 224, which coincides with the size of the foam inserts 214 and 214*a*.

Figure 3:
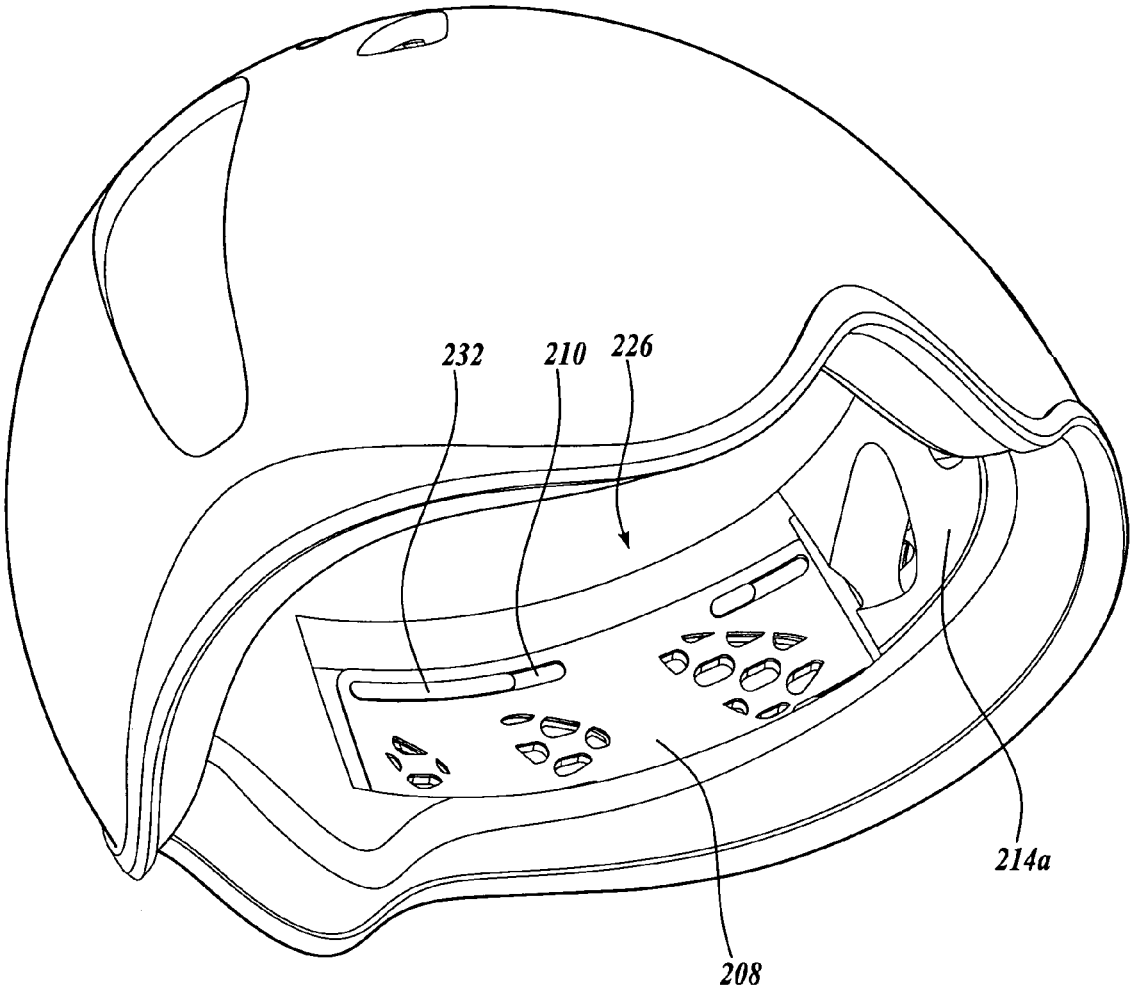
FIG. 3 is a diagrammatical illustration of the interior of the helmet of FIG. 1.

After the completion of the in-mold process to join the vent shield 104 to the foam liner 224, the vent airflow regulator 208 is placed over and behind the vent shield 104 within the notch 226 left behind by the mandrel, as illustrated in FIG. 3. The rails 232 at the back of the vent shield 104 are seen engaged to the guides 210 of the vent airflow regulator 208. The space left over in the guides 210 that is not engaged to the rails 232 can determine the amount of left and right sliding movement, which should be sufficient to cover the vent holes 124 of the vent shields. The foam insert 214*a* is seen already being placed in position within one-half of the notch 226. The second foam insert 214 will next be placed within the notch 226 and joined to the foam liner 224 and to the first foam insert 214*a* via a mechanical connection or an adhesive.

Figure 4:
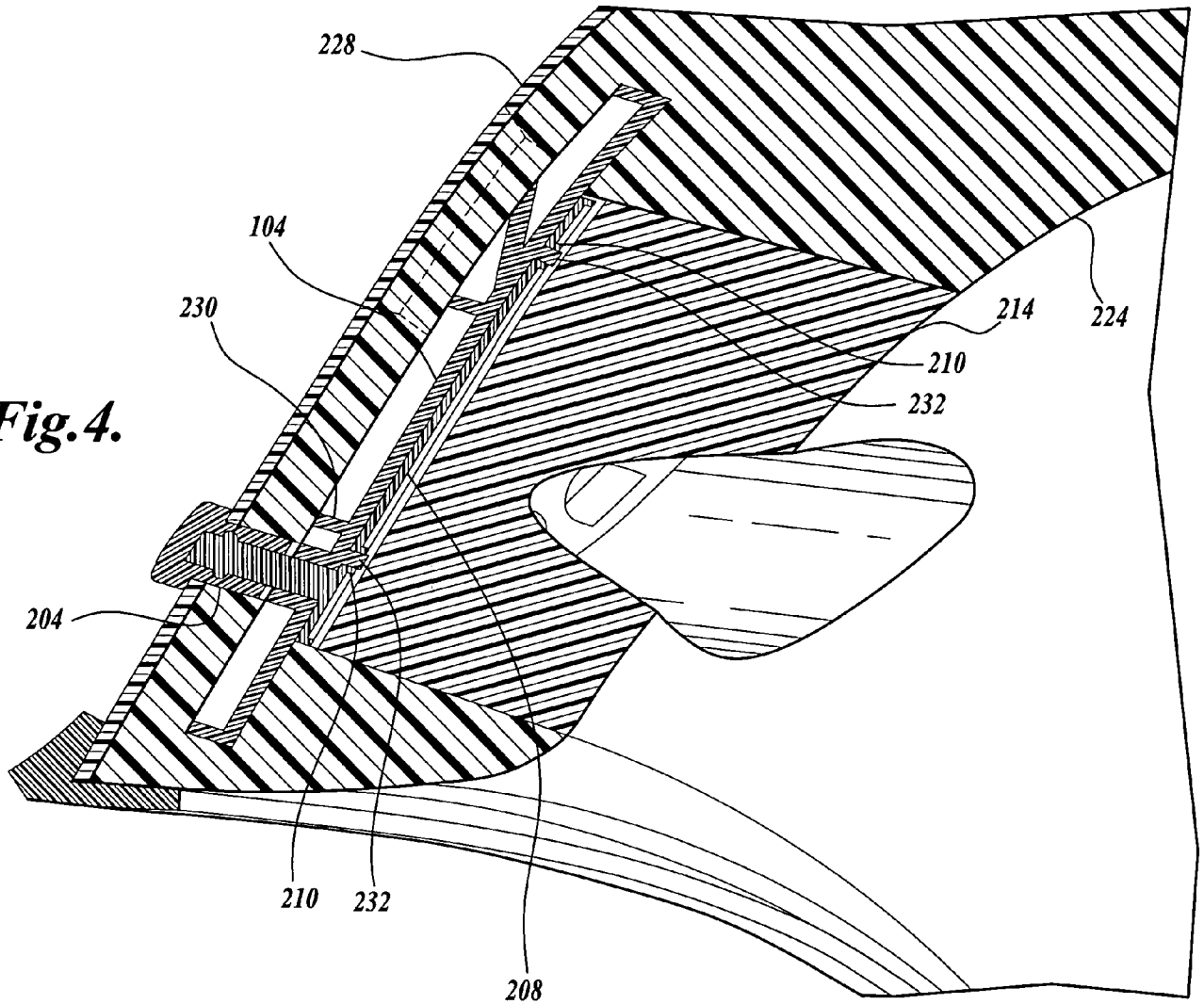
FIG. 4 is a diagrammatical illustration of a cross-sectional view of the helmet of FIG. 1.

Referring to FIG. 4, a cross-sectional illustration of the helmet 100 is provided. The exterior shell 228 is a thin, impact resistant material that spreads the impact over a larger area. Juxtaposed and directly next to the interior of the shell 228 is the foam inner liner 224. The foam inner liner 224 expands in front of the vent shield 104 between the shell 228 and the vent shield 104 that provides an offset for preventing bleed through of the vent shield 104. The vent shield 104 is adjacent to and directly disposed next to this layer of foam. As is visible in the illustration, the foam inner liner 224 forms over and around the back perimeter of the vent shield 104. This is a result of the in-mold process described above. This secures the vent shield 104 to the foam liner 224 through the use of the anchor holes 206 provided in the perimeter of the vent shield 104. The vent shield 104 includes a neck for the slot 204 that extends through the offset in the foam liner 224 and to just about the surface of the outer shell 228 to be flush with it. The vent airflow regulator 208 is juxtaposed and directly adjacent to the back of the vent shield 104. The arm 220 of the vent airflow regulator 208 passes through the neck in slot 204 and extends partly beyond the exterior of the outer shell 228. The knob 106 is fastened to the end of the arm 220, thereby providing the ability to manually slide the vent airflow regulator 208 between the opened and the closed vent positions. The shell 228 and/or part of the liner 224 can have a groove in it as well that also assists in the sliding of the knob 106 back and forth when the knob 106 sits against the groove. Another function of the rails 232 of the vent shield 104 are as risers which extend beyond the guides 210 of the vent airflow regulator 208. The rails 232 abut against the foam insert 214 to prevent the foam insert 214 from pressing on the vent airflow regulator 208 and restricting the sliding motion of the vent airflow regulator 208.

The disclosed embodiment differs from conventional vent sliders that come pre-assembled within a box. The entire box including the slider is placed in the mold to be attached to the foam during the in-mold process. The disclosed embodiment uses an open configuration and attaches the vent shield 104 to the foam liner, however, the vent airflow regulator is attached afterwards. The vent airflow regulator 208 and foam insert 214 are post-applied after the molding process. This eliminates the need for in-molding a back and front section of the box to create space for the slider to move, which keeps the weight lighter. Also, when in-molding the slider in an enclosed box, as in the conventional manner, a heavier, more rigid structure is needed to resist collapse of the box space from high in-molding pressures and temperatures. Collapse of the slider space would pinch the slider and inhibit proper function. The post-applied vent airflow regulator in the disclosed embodiment obviates the need for a heavy housing to create the space necessary for the airflow regulator to move in. The following description provides for additional views of the helmet 100 in accordance with one embodiment of the present invention.

Figure 5:
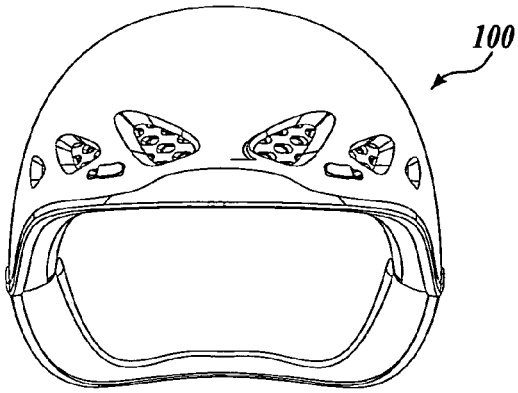
FIG. 5 is a diagrammatical illustration of a front view of the helmet of FIG. 1.

FIG. 5 is an illustration of a front view of the helmet 100.

Figure 6:
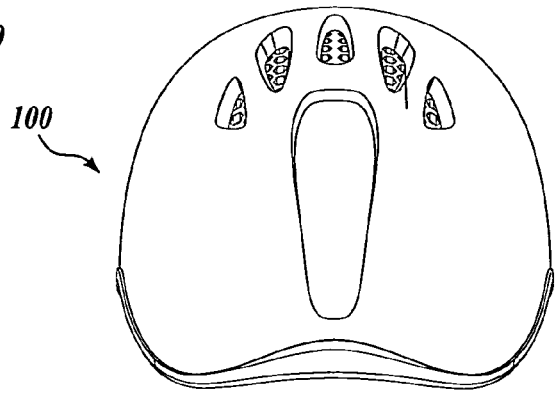
FIG. 6 is a diagrammatical illustration of a back view of the helmet of FIG. 1.

FIG. 6 is an illustration of a back view of the helmet 100.

Figure 7:
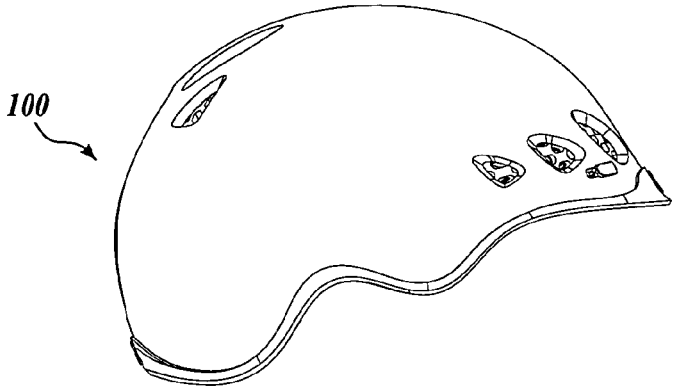
FIG. 7 is a diagrammatical illustration of a side view of the helmet of FIG. 1 with the opposite side being a mirror image.

FIG. 7 is an illustration of a side view of the helmet 100, the opposite side being the mirror image thereof.

Figure 8:
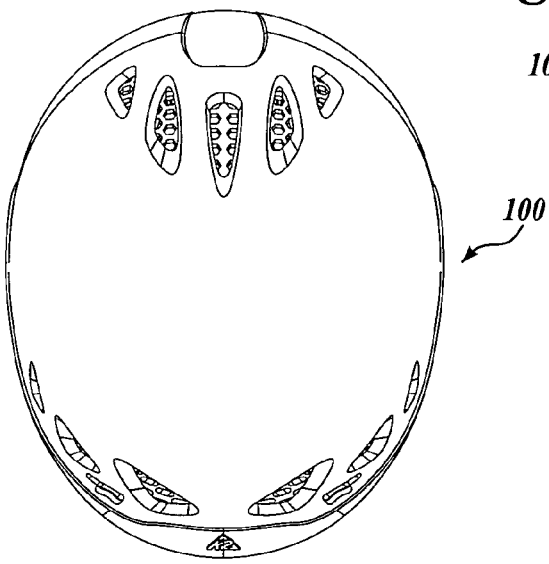
FIG. 8 is a diagrammatical illustration of a top view of the helmet of FIG. 1.

FIG. 8 is an illustration of a top view of the helmet 100.

Figure 9:
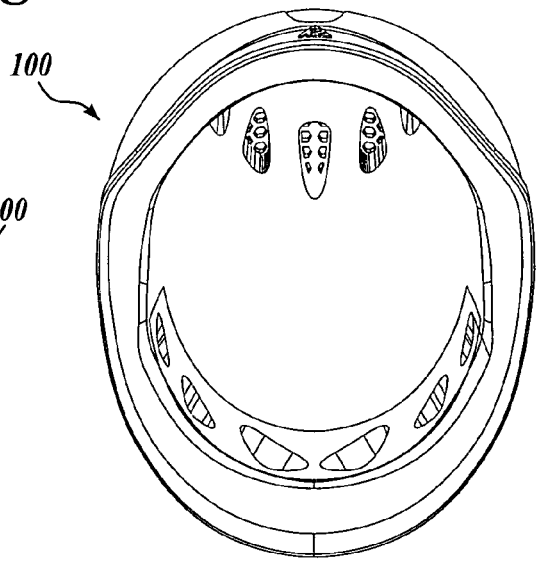
FIG. 9 is a diagrammatical illustration of a bottom view of the helmet of FIG. 1.

FIG. 9 is an illustration of a bottom view of the helmet 100.

Figure 10:
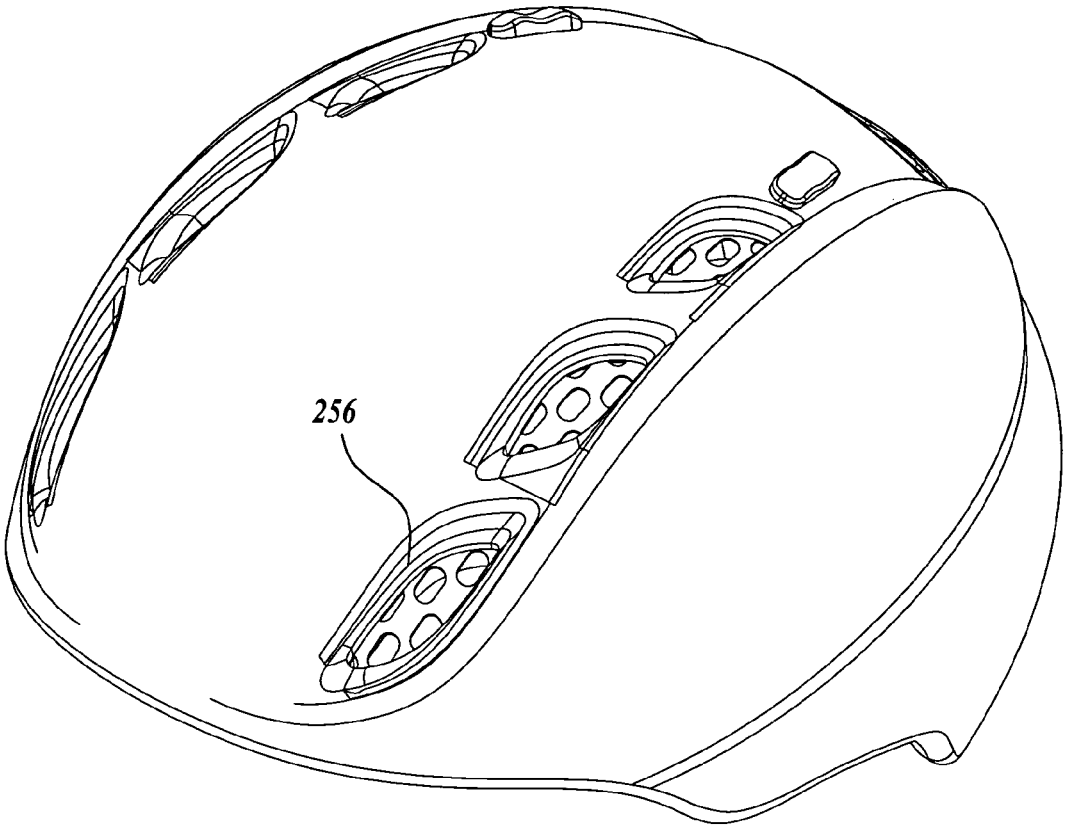
FIG. 10 is a diagrammatical illustration of a helmet in accordance with another embodiment of the present invention.
Figure 11:
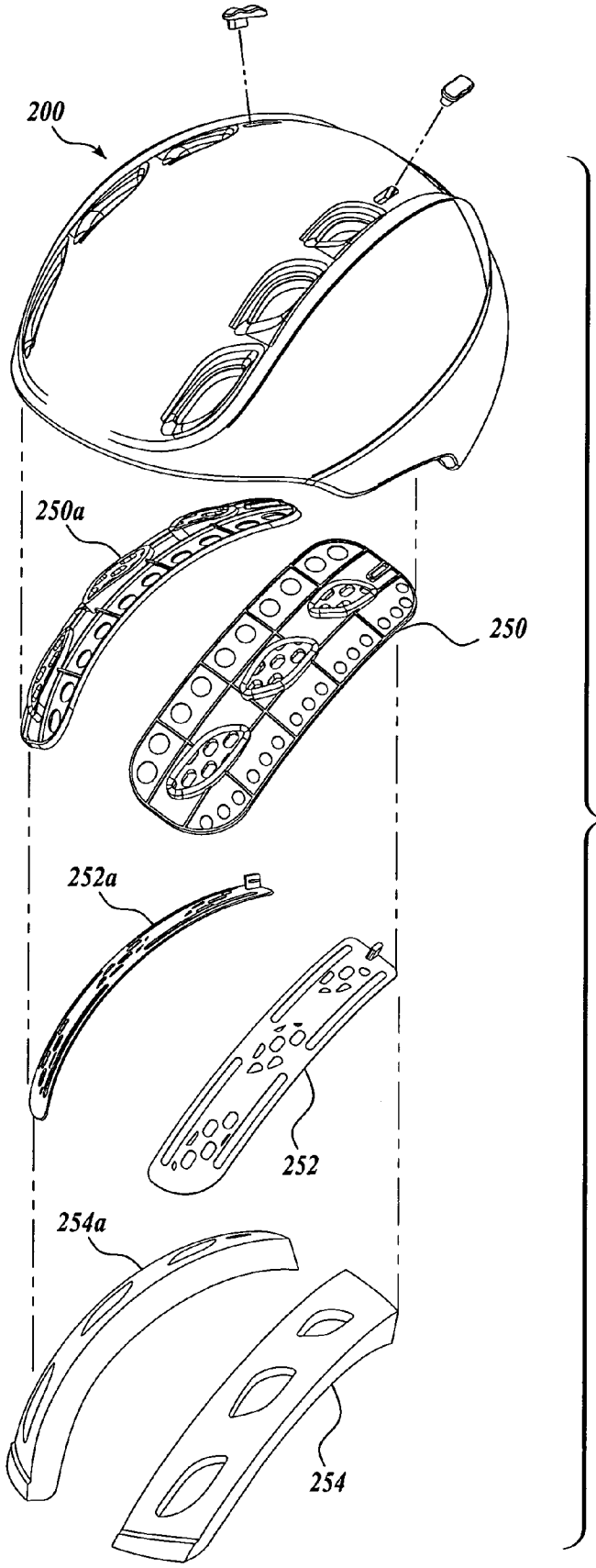
FIG. 11 is a diagrammatical illustration of an exploded view of the helmet of FIG. 10.

Referring to FIGS. 10 and 11, a second embodiment of a helmet 200 is illustrated. The helmet 200 includes vent holes 256 made along the front of the helmet and disposed generally vertically from front to back along two sides of the helmet to provide a symmetrical appearance on each side of the helmet 200. Referring to FIG. 11, the helmet 200 includes, for each row of vents 256, a vent shield 250, a vent airflow regulator 252, and a foam insert 254 that are substantially similar to the embodiments described in association with FIGS. 1-4 above. The manner of using and making the helmet 200 is substantially similar to the manner of using and making the helmet 100 of FIGS. 1-4. However, in the embodiment shown in FIGS. 10 and 11, the vent airflow regulators 252 and 252*a* can slide vertically, whereas the vent airflow regulators 208 and 208*a* of the helmet 100 can slide horizontally. The following description provides for additional views of the helmet 200 in accordance with one embodiment of the present invention.

Figure 12:
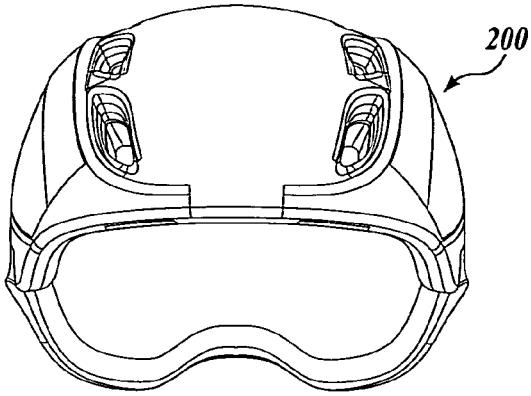
FIG. 12 is a diagrammatical illustration of a front view of the helmet of FIG. 10.

FIG. 12 is an illustration of a front view of the helmet 200.

Figure 13:
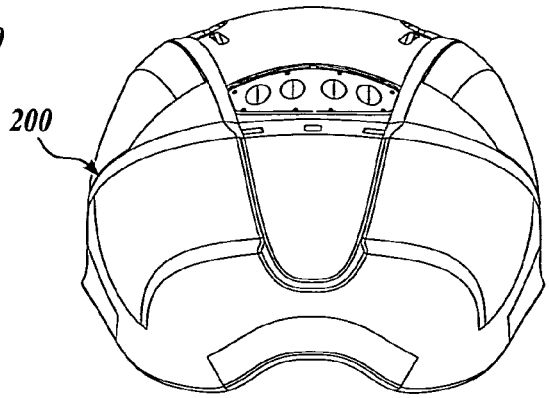
FIG. 13 is a diagrammatical illustration of a back view of the helmet of FIG. 10.

FIG. 13 is an illustration of a back view of the helmet 200.

Figure 14:
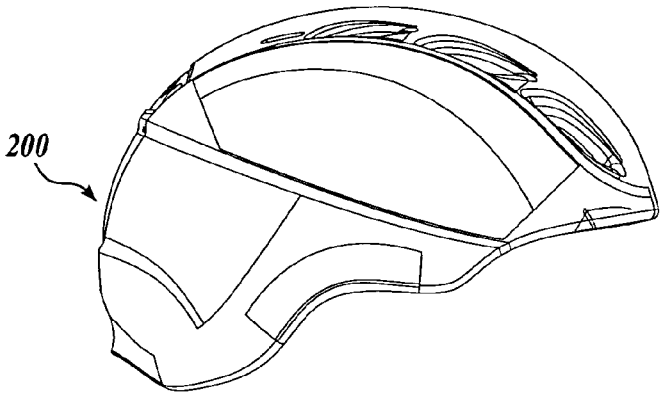
FIG. 14 is a diagrammatical illustration of a side view of the helmet of FIG. 1 with the opposite side being a mirror image.

FIG. 14 is an illustration of a side view of the helmet 200, the opposite side being the mirror image thereof.

Figure 15:
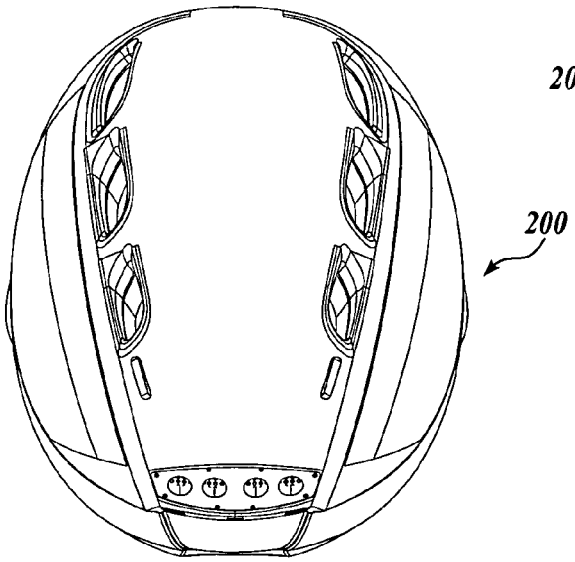
FIG. 15 is a diagrammatical illustration of a top view of the helmet of FIG. 10.

FIG. 15 is an illustration of a top view of the helmet 200.

Figure 16:
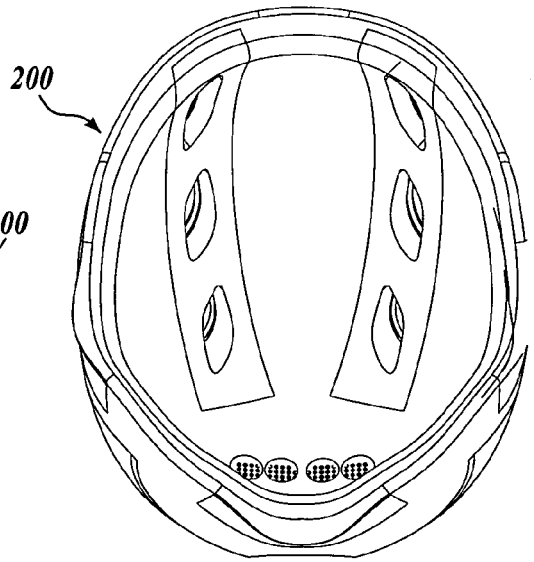
FIG. 16 is a diagrammatical illustration of a bottom view of the helmet of FIG. 1.

FIG. 16 is an illustration of a bottom view of the helmet 200.

While illustrative embodiments have been illustrated and described, it will be appreciated that various changes can be made therein without departing from the spirit and scope of the invention.

The embodiments of the invention in which an exclusive property or privilege is claimed are defined as follows:

1. A helmet, comprising:

an exterior helmet form having a first plurality of vent holes of a first size;

a vent shield positioned over the first plurality of vent holes, the vent shield having a second plurality of vent holes arranged in a plurality of distinct patterns, wherein each distinct pattern comprises a plurality of vent holes, wherein each of the second plurality of vent holes has a second predetermined size smaller than the first size, and each distinct pattern of vent holes coincides with one of the plurality of vent holes in the helmet form; and a vent airflow regulator positioned over the vent shield, the vent airflow regulator having a third plurality of vent holes arranged in a plurality of distinct patterns having substantially the same shape as the patterns in the vent shield, wherein each of the third plurality of vent holes is at least about as large as the corresponding second predetermined size, wherein the vent airflow regulator is positionable to align the vent holes of the vent shield with the vent holes of the vent airflow regulator and positionable to close the vent holes of the vent shield.

2. The helmet of claim 1, further comprising an outer shell and an inner foam liner, wherein the vent shield is attached within the liner by expansion of the liner foam into interstices of the vent shield.

3. The helmet of claim 1, wherein the vent shield includes a thin plastic component and anchor holes are provided around the perimeter of the vent shield to allow foam material to enter the holes to anchor the vent shield to the foam.

4. The helmet of claim 1, further comprising an inner foam liner with a notch behind the vent shield into which the vent airflow regulator is positioned.

5. The helmet of claim 1, further comprising an inner foam liner with a notch in the liner sized to receive the vent airflow regulator.

6. The helmet of claim 1, wherein the vent shield includes rails and the vent airflow regulator includes guides so that the guides ride in the rails and allow the vent airflow regulator to be positioned to allow a varying degree of airflow through the vent hole of the vent shield.

7. The helmet of claim 1, wherein the vent shield includes rails and the vent airflow regulator includes guides so that the guides ride in the rails and the rails protrude past the guides to prevent a foam insert from pressing against the vent airflow regulator.

8. The helmet of claim 1, further comprising a foam insert over the vent airflow regulator which maintains the vent airflow regulator in position.

9. The helmet of claim 1, wherein the vent shield is attached to the helmet via a process which causes a foam to expand over and around the perimeter of the vent shield and a mandrel prevents the foam from expanding behind the vent shield that creates a notch sized to receive the vent airflow regulator.

10. The helmet of claim 1, wherein the vent shield is attached to the helmet via a process which causes a foam to expand over and around the perimeter of the vent shield and a mandrel prevents the foam from expanding behind the vent shield that creates a notch sized to receive the vent airflow regulator, wherein the vent airflow regulator is applied after the vent shield is attached.

11. The helmet of claim 1, further comprising an outer shell and an inner foam liner, wherein the vent shield is separated from the shell by a layer of foam material disposed between the inner surface of the shell and the vent shield.

12. The helmet of claim 1, wherein the vent shield includes a neck disposed on the front side, and the vent airflow regulator includes an arm disposed on the front side passing through the neck, and a knob attached to the end of the arm holds the vent airflow regulator in position.

13. The helmet of claim 1, wherein the vent shield comprises ribs on the front side that criss cross to form intersecting lines.

14. The helmet of claim 1, wherein the vent shield comprises rails on the back side that protrude past the vent airflow regulator to provide space within which the vent airflow regulator can slide back and forth.

* * * * *